United States Patent [19]

Weseloh

[11] 3,998,430

[45] Dec. 21, 1976

[54] HAND BRAKE FOR RAILROAD CARS

[75] Inventor: Roger J. Weseloh, Glenwood, Ill.

[73] Assignee: Westinghouse Air Brake Company, Pittsburgh, Pa.

[22] Filed: June 2, 1975

[21] Appl. No.: 582,779

[52] U.S. Cl. ..... 254/149; 74/505; 192/16

[51] Int. Cl.[2] ..... B66D 1/00

[58] Field of Search ..... 254/149, 150 R, 186 HC, 254/187 R; 74/505, 506, 805, 337; 192/16

[56] References Cited

UNITED STATES PATENTS

| | | | |
|---|---|---|---|
| 2,694,944 | 11/1954 | Klasing, Jr. et al. | 74/505 |
| 3,408,881 | 11/1968 | Grube | 254/149 |
| 3,453,902 | 7/1969 | Belle | 74/505 |
| 3,668,944 | 6/1972 | Natschke | 74/505 |
| 3,923,287 | 12/1975 | Weseloh et al. | 74/505 |

*Primary Examiner*—Robert J. Spar
*Assistant Examiner*—Kenneth Noland
*Attorney, Agent, or Firm*—McWilliams & Mann

[57] ABSTRACT

A hand brake for railroad cars comprising a housing including a front casing and a rear or back plate, between which an operating shaft is journaled (that bears the usual vertical hand wheel), and within which is mounted the brake drum in concentric relation to the operating shaft. A ratchet mechanism permits winding of the brake chain in one direction only, and the winding of the brake drum is through a non-rotating but gyrating pinion that meshes with a ring gear that is part of the drum, the pinion being actuated through an eccentric sleeve that is journaled for rotation about the operating shaft. The brake drum is journaled in concentric relation about the operating shaft on bearing plates respectively affixed to the housing front casing and back plate, with the housing back bearing plate having an integral annular flange in which the inner end of the operating shaft is journaled, and on which the eccentric is journaled. The ratchet mechanism is also disposed within the annular flange and is clutched to the shaft through friction clutch cooperation with a nut threaded on the shaft that is splined to a jaw clutch member that cooperates with jaw clutch seats or pockets in the eccentric whereby the operating shaft is releasably keyed to the eccentric to rotate the same for actuating the pinion for chain wind up purposes. The jaw clutch device involved also is operative to establish the friction clutch relationship that the nut has with the ratchet mechanism whereby the tension acting on the brake chain keeps the ratchet mechanism operative to prevent rotation of the shaft in a direction which would unwind the chain.

15 Claims, 10 Drawing Figures

HAND BRAKE FOR RAILROAD CARS

This invention relates to a hand brake for railroad cars, and more particularly, to improvements in non-spin hand brake arrangements of the general type shown in U.S. Pat. Nos. 2,848,038, 3,390,590, and 3,625,086. More particularly, the invention is concerned with a hand brake of the type disclosed in the application of Roger J. Weseloh and Wajih Kanjo Ser. No. 521,339, filed Nov. 6, 1974, now U.S. Pat. No. 3,923,287.

The hand brake arrangements of said patents are concerned with non-spin vertical hand wheel type hand brake mechanisms for manually setting the brakes of a railroad car, in which controlled or full release actions are provided for.

A principal object of this invention is to generally improve such hand brakes, and in particular, provide a high powered hand brake arrangement that is adapted for both limited and continuous wind applications.

Another principal object of the invention is to arrange the hand brake so that the chain winding drum is concentric with the hand brake operating shaft that is rotated relative thereto for chain winding purposes through gearing that operates about the operating shaft in association with ratchet and clutch mechanisms that are similarly oriented for minimizing the brake unit size.

Yet another important object of the invention is to arrange the hand brake so that not only are limited or cntinuous wind applications provided for, but a particular hand brake unit may be optionally arranged for either full or partial power, with chain movement in either direction about the brake operating shaft, by selecting gear tooth combinations and gearing that are fully interchangeable with the basic hand brake unit.

Other objects of the invention are to simply brake mechanisms of the type indicated, to provide a ring gear type wind mechanism therefor, and to provide a hand brake arrangement that is economical of manufacture, convenient to install and use, and long lived and reliable in operation.

In accordance with this invention, the hand brake arrangement comprises a housing including a front casing and a rear or back plate between which the operating shaft is journaled, and within which is mounted the brake drum in concentric relation to the operating shaft. A ratchet mechanism permits winding up of the brake chain in one direction only. For winding of the drum, a ring gear type gearing mechanism is provided in which a non-rotating but gyrating pinion is provided that meshes with a ring gear that is part of the drum, with the pinion being actuated through an eccentric sleeve mounted to be rotated by the shaft on hand operation of the shaft to set the car brakes.

The brake drum is journaled in concentric relation about the shaft on bearing plates respectively affixed to the front casing and back plate, with the back plate bearing plate having an integral annular flange in which the inner end of the operating shaft is journaled, and on which the eccentric is journaled. The ratchet mechanism is also disposed within the annular flange and is clutched to the shaft through friction clutch cooperation with a nut threaded on the shaft that is splined to a jaw clutch member of a jaw clutch device that cooperates with the eccentric whereby the operating shaft is releasably keyed to the eccentric to rotate same for actuating the pinion for chain wind up purposes.

The annular flange is formed with spaced pockets that each receive a roller forming a pawl for locking the ratchet against rotation in the chain unwinding direction on the shaft. the nut and ratchet are formed with friction clutch surfaces to form a first clutch device that releasably clutches the shaft to the ratchet to preclude chain unwinding rotation of the shaft while permitting chain winding motion of the shaft. The eccentric is formed with jaw clutch pockets whereby the jaw clutch member of the jaw clutch and the eccentric pockets form a second clutch device that includes a reciprocating jaw clutch member to which the nut is splined for releasably clutching the shaft to the eccentric for rotation of the latter on rotation of the shaft. The shaft threading on which the nut is mounted is of a hand which feeds the nut axially of the shaft to close the nut and ratchet mechanism friction surfaces whereby, when the second clutch device is in operation, the tension on the brake chain maintains the first clutch device operative whereby the ratchet will hold the shaft against chain unwinding movement.

The arrangement provides for controlled release on hand rotation of the shaft in its unwinding direction, and quick or full release by way of a release mechanism to unclutch the jaw clutch from the eccentric.

Other objects, uses and advantages will be obvious or become apparent from a consideration of the following detailed description, in which like reference numerals indicate like parts through the several views.

However, it is to be distinctly understood that the specific drawing illustrations provided are supplied primarily to comply with the requirements of the Patent Laws, and that the invention is susceptible of variations and alternate embodiments which will be obvious to those skilled in the art, and which are intended to be covered by the appended claims.

GENERAL DESCRIPTION

Figure 1:
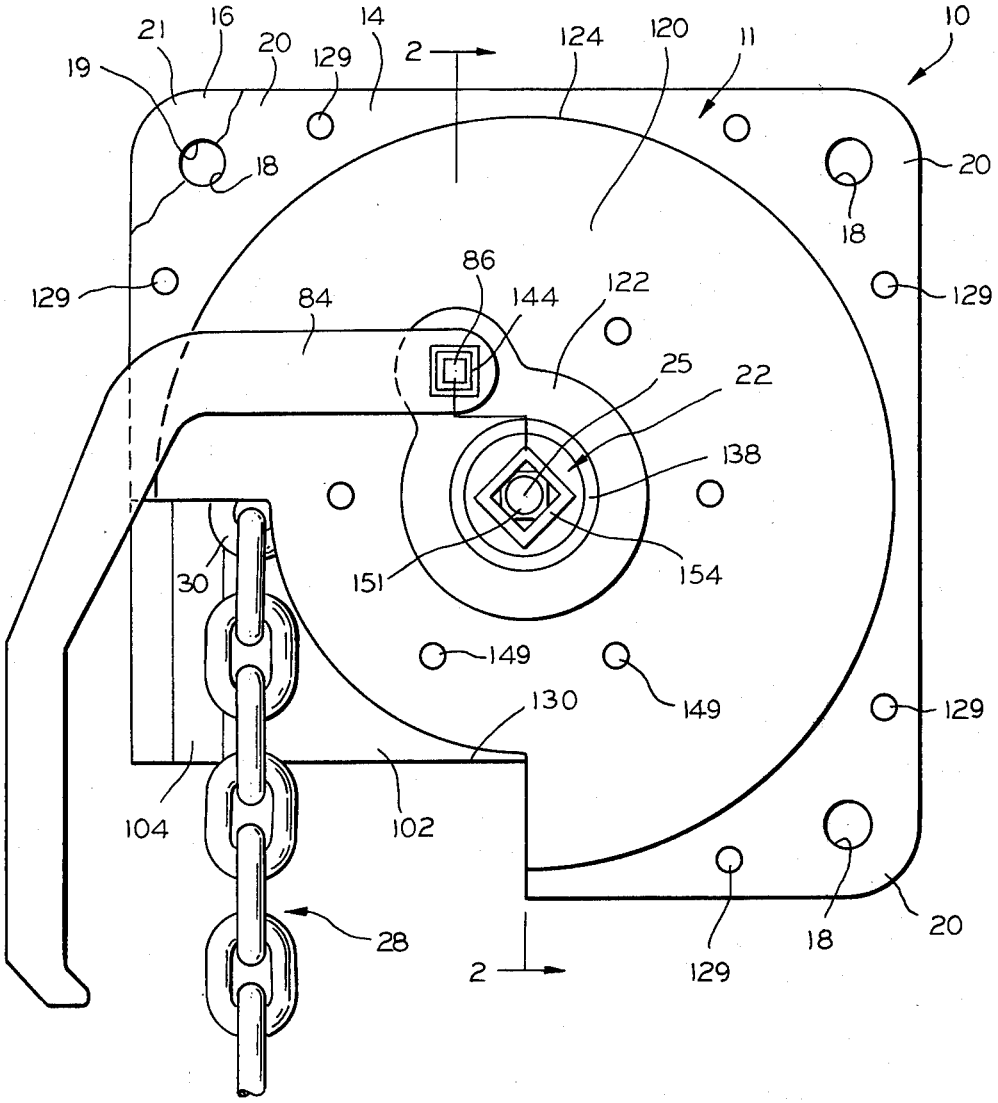
FIG. 1 is a front elevational view of an embodiment of the invention arranged for limited wind, with the usual vertical hand wheel omitted for clarity of illustration.
Figure 2:
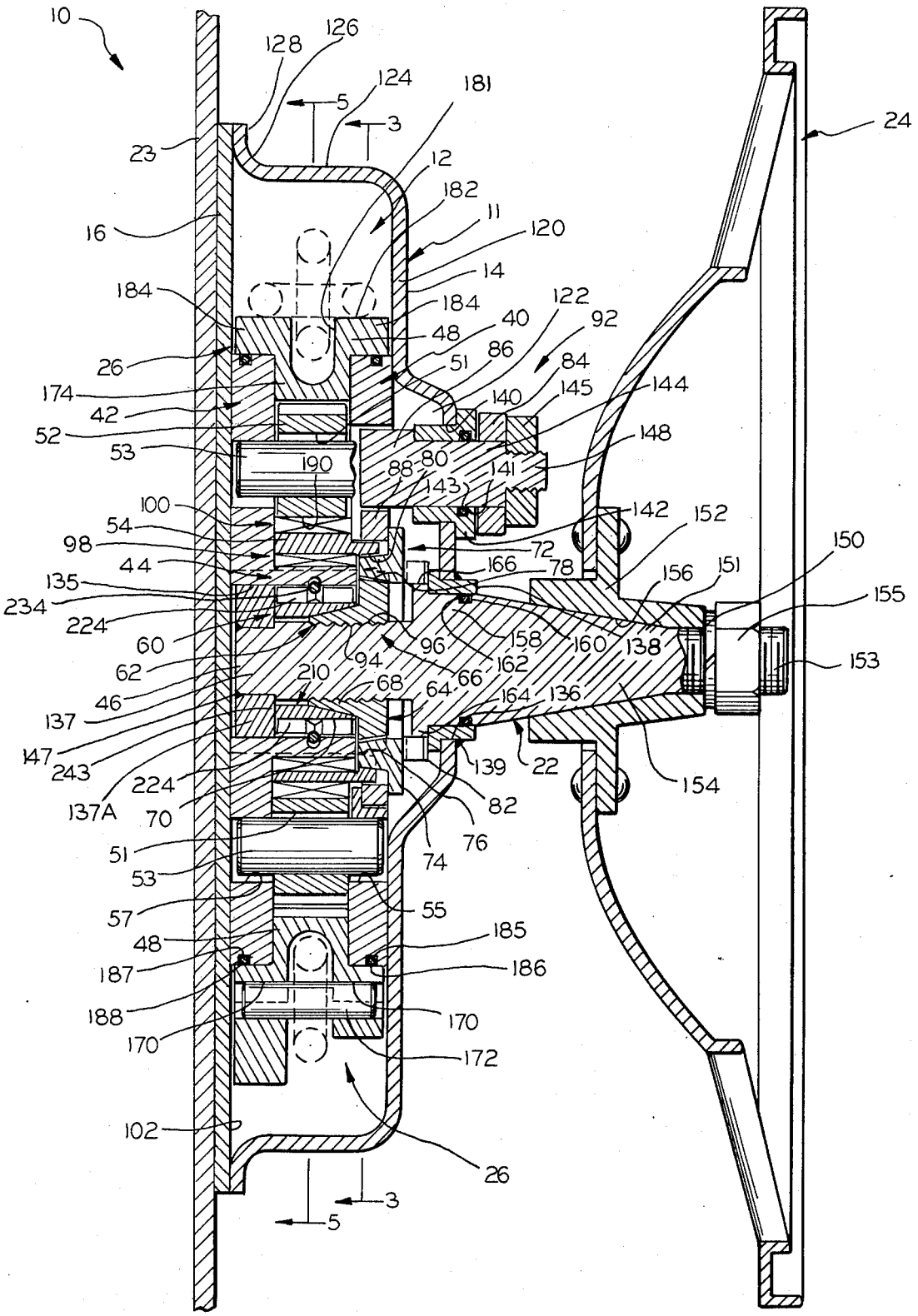
FIG. 2 is a diagrammatic sectional view of the hand brake taken substantially along line 2—2 of FIG. 1.

Reference numeral 10 of FIGS. 1 and 2 generally indicates one embodiment of the invention, arranged for limited wind, and positioned as it would be applied to a railroad car, in which the brake operating mechanism is indicated at 12 and is contained in housing 11.

The housing 11 is in the form of two sections comprising a front casing 14 and a back section or rear plate 16 of generally quadrilateral configuration defining bolt receiving openings 18 and 19 at their respective corners 20 and 21 adapted to receive suitable bolts (not shown) for securing the hand brake housing 11 together and to a suitable mounting plate 23 (see FIG. 2) arranged for suitably securing the hand brake 10 in its operating position on the car (in which position the hand brake 10 is positioned substantially as shown in FIGS. 1 and 2, with the back section or rear plate vertically disposed).

The operating mechanism 12 of the hand brake 10 generally comprises an operating shaft 22 that is journaled in the housing between the front casing 14 and the back plate 16 and has suitably keyed thereto the familiar hand wheel 24 that the operator employs to apply the car brakes (which is omitted from the showing of FIG. 1). It will be understood, of course, that Other types of leverage applying means may be operably associated with shaft 22, such as a suitable type of swing lever, as is well known by those skilled in the art.

Operably associated with the operating shaft 22 is the winding drum 26 to which brake chain 28 has one end 30 suitably secured (in the form of FIGS. 1–9) for winding up on the brake drum 26 utilizing the operating shaft 22.

The brake drum 26 is of annular configuration and is journaled in substantial concentric relation with respect to shaft 22, on and between front and rear bearing plates 40 and 42 that are respectively suitably affixed to the front casing and rear or back plate in concentric relation to the shaft 22. The rear bearing plate 42 includes an integral annular flange 44 that is concentric with shaft 22, and within which the inner end 46 of the shaft 22 is journaled.

The brake drum 26 is in the form of annular member 48 shaped to define internal ring gear portion 50 that is concentric with the axis of rotation 25 of shaft 22 and is in meshing relation with a pinion 52 that is eccentrically disposed relative to the operating shaft axis 25 and that is journaled on eccentric sleeve 54 for rotation about an eccentric axis 56. Eccentric sleeve 54 in turn is journaled on annular flange 44 for rotation about operating shaft axis 25. In the form shown, pinion 52 is formed with a plurality of circumferentially spaced apertures 51 that each loosely receive a pin 53. Pins 53 each have their respective ends loosely received in the respective apertures or openings 55 and 57 formed in the respective bearing plates 40 and 42. The apertures 55 and 57 for each pin 53 are aligned axially of shaft 22.

The winding drum ring gear portion 50, the pinion 52, and the eccentric sleeve 54 comprise a gear mechanism 58 that is operated by the operating shaft 22 to provide the mechanical advantage desired in winding up the brake chain 28 on brake drum 26.

Operably associated with the shaft 22 and annular flange 44 is ratchet mechanism 60 which cooperates with the shaft 22 through clutch device 62 that comprises nut 64 threadedly mounted on the shaft 22 as at 66 and that includes a friction clutch portion 68 which cooperates with a friction clutch portion 70 of the ratchet mechanism 60, to operatively and releasably clutch the operating shaft 22 with the ratchet mechanism 60.

Operably associated with the nut 64 is a jaw clutch device 72 comprising an annular jaw clutch member 74 disposed in concentric relation with the shaft 22 and shaped to define circumferentially spaced jaw clutch lugs or teeth 76 that make a splined connection with similarly circumferentially spaced grooves or slots 78 of the nut 64. The lugs 76 of the jaw clutch member 74 also are adapted to be disposed in interfitting relation with correspondingly located seats or pockets 80 formed in the eccentric sleeve 54. The jaw clutch member 74 is movable axially of the operating shaft 22 and is resiliently biased to its clutching position shown in FIG. 2, with respect to the eccentric sleeve 54, by a suitable biasing means such as the wave spring 82 (see FIG. 2). the movement of jaw clutch member 74 axially of the shaft 72 is limited so that while its lugs 76 may be unseated from the pockets 80 of the eccentric sleeve 54, they will not fully leave the grooves or slots 78 of the nut 64, whereby the jaw clutch member 74 remains in the splined connection with the nut 64 in all its operative positions.

Figure 7:
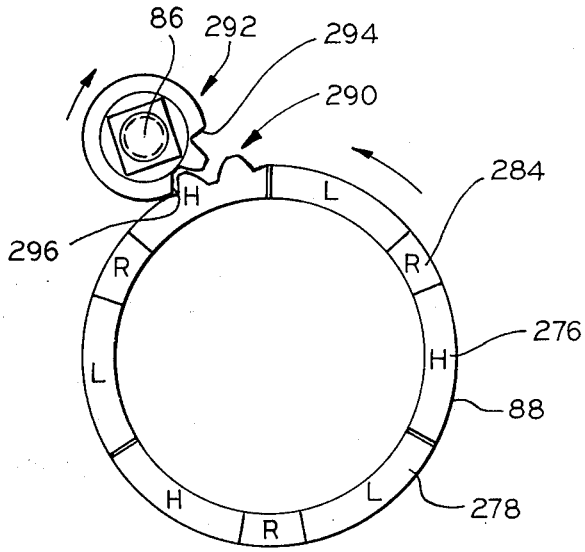
FIG. 7 is a diagrammatic plan view illustrating the general arrangement of the device release shaft and associated cam ring employed in connection with the illustrated embodiment to provide for full release of the brake.
Figure 8:
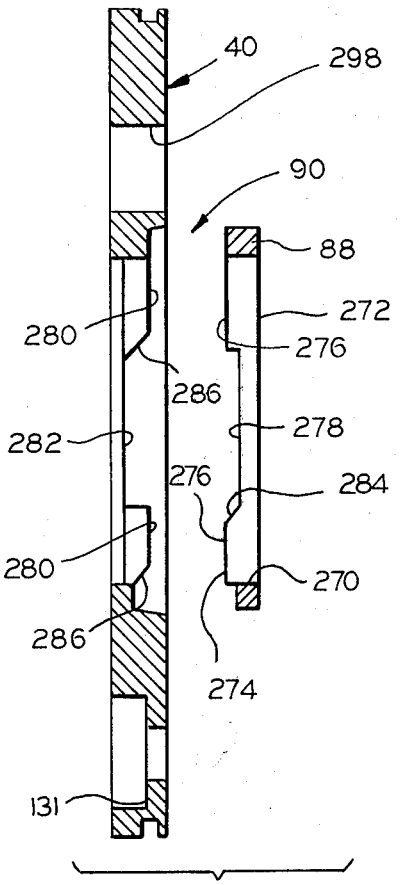
FIG. 8 is a diagrammatic exploded sectional view of the cam ring and camming surfaces of the front casing bearing plate that provide for full release of the brake.
Figure 9:
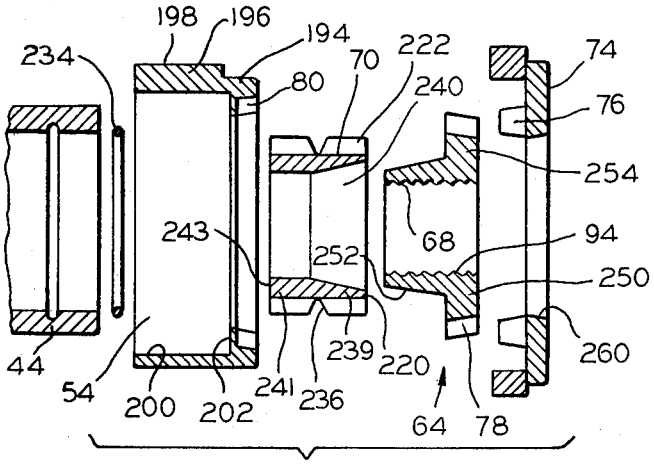
FIG. 9 is a diagrammatic exploded view in section illustrating several of the basic ratchet and clutching components of the illustrated embodiment of the invention.

The jaw clutch member 74 may be moved to the right of FIG. 2 against the biasing action of the spring 82 by moving the actuating arm 84 that is keyed to release shaft 86 suitably journaled in the housing 11 which is coupled to the cam ring 88 best shown in FIGS. 7–9 that serves as a cam follower, and operates in conjunction with the camming portion 90 of bearing 40, against which the ring 88 is biased by the action of the spring 82 on jaw clutch member 74.

The release shaft 86 and its arm 84 together with the cam ring 88 and the camming portion 90 of bearing plate 40 provide a release device 92 for unclutching the clutch device 72 from the eccentric sleeve 54 to achieve quick release of the brake.

The threading 66 that connects the nut 64 to the operating shaft 22 comprises internal threading 94 on the nut and external therading 96 on the shaft 22 having a hand such that when the brake chain 28 is under tension, and the jaw clutch 72 is in clutched relation with the eccentric sleeve 54, the tension on the brake chain acting through the brake drum 26 and the eccentric sleeve 54 will tend to turn the nut 64, through the clutch device 72, in the direction of the ratchet device 60 whereby the clutch device 62 operates to frictionally clamp the ratchet assembly in operative relation with the operating shaft 22 as well as with the brake drum 26.

Suitable needle bearings 98 are shown applied between the annular flange 44 and the eccentric sleeve 54, while suitable needle bearings 100 are shown applied between the pinion 52 and the eccentric sleeve 54; it is to be understood, of course, that these are illustrative only of the various types of bearings that may be employed between the parts indicated, as suitable plain bearings or other types of antifriction bearings may be employed as found to be necessary or desirable for particular applications.

For the limited wind hand brake 10 shown in FIGS. 1–9, the back plate 16 has suitably affixed to its inner surface 102 a stop lug 104 (see FIGS. 1, 3 and 5) which is engaged by a protuberant or projecting portion 106 of the brake drum. The stop lug 104 defines upwardly facing or top surface 108 against which the protuberant or projecting portion 106 of the brake drum seats to serve as a stop for limiting the unwinding motion of the brake drum when the brake is released. The side 110 of the stop lug also serves as a stop for limiting the windup motion of the drum, at which position the drum projecting portion 106 disposes chain 28 against the side 110 of the stop lug 104.

Figure 3:
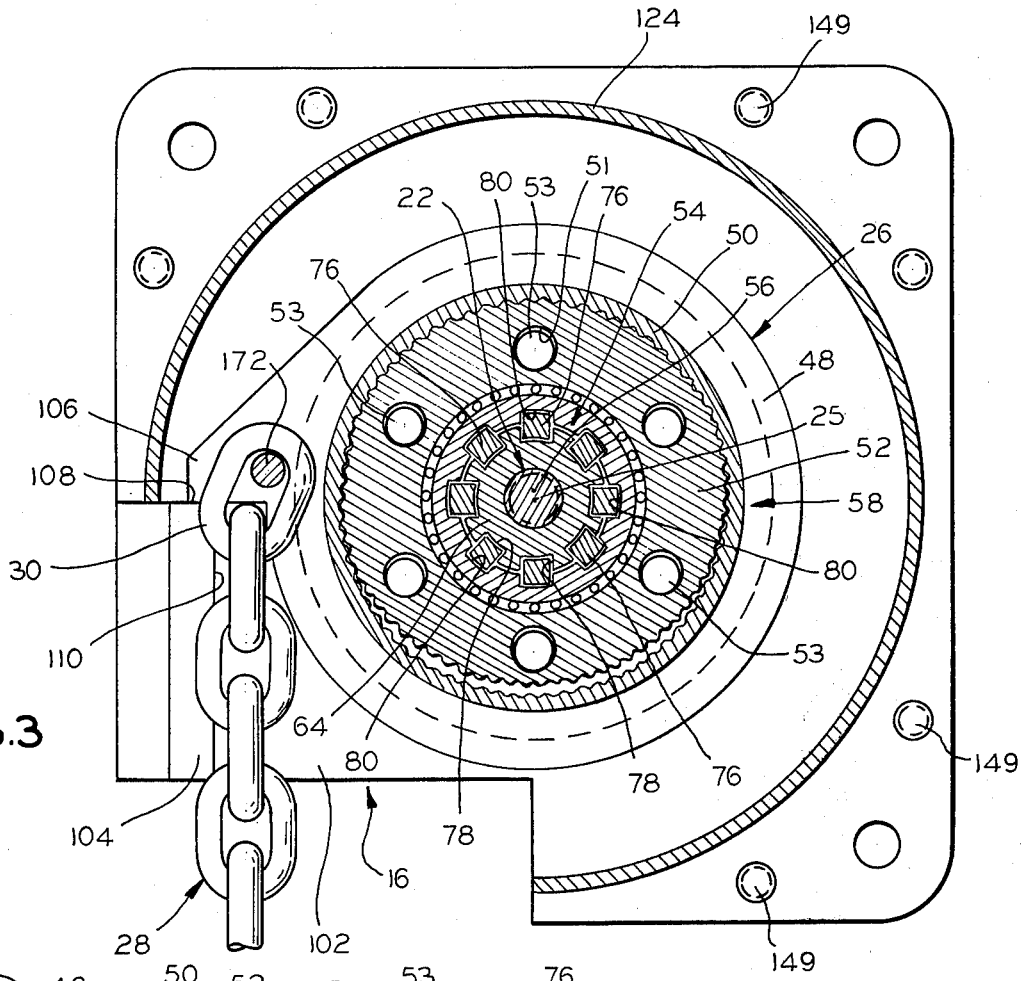
FIG. 3 is a diagrammatic vertical sectional view taken substantially along line 3—3 of FIG. 2 with some parts shown in elevation and the release shaft and some of its associated parts omitted for ease of illustration, and with the winding drum shown in its release position.
Figure 4:
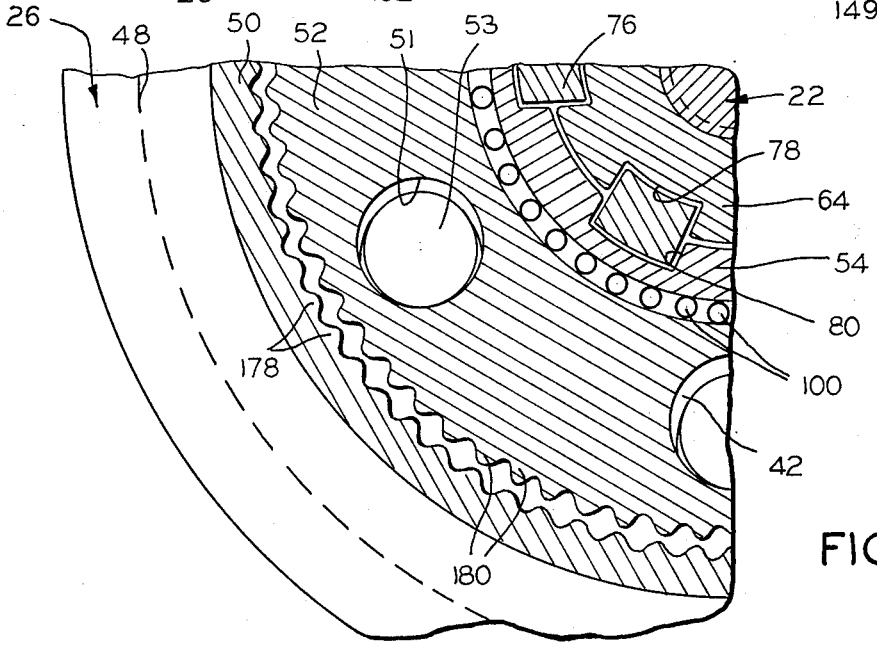
FIG. 4 is a fragmental view similar to that of FIG. 3 but illustrating on a larger scale a portion of the gearing and clutch mechanisms that are shown in FIG. 3.
Figure 5:
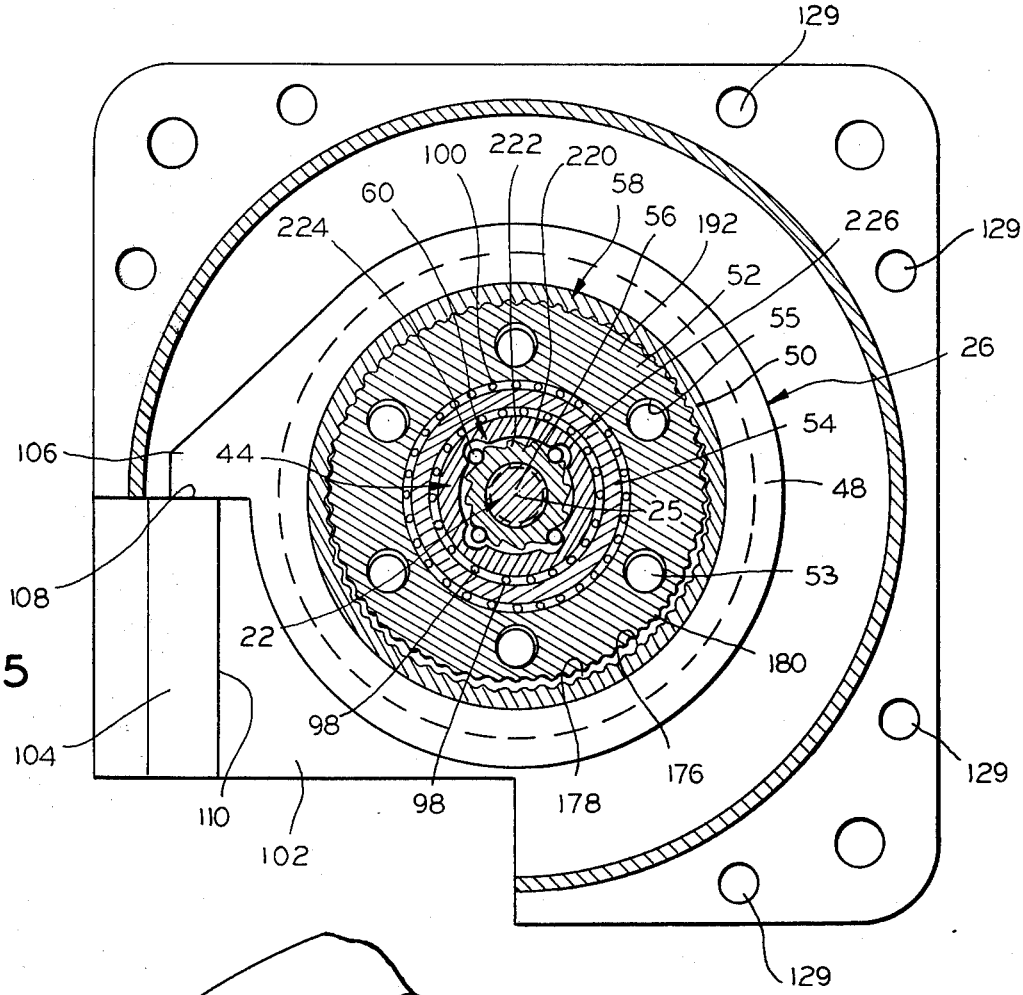
FIG. 5 is a view similar to that of FIG. 3 but taken substantially along line 5—5 of FIG. 2.

The hand brake 10 is preferably proportioned and arranged for 26 to 28 inches of brake chain wind up which may be accomplished in approximately 315 degrees of rotational movement of the brake drum clockwise of the position of FIGS. 1, 3 and 5.

Assuming the brake device 10 is mounted in its operating position, the brake chain 28 is suitably connected to the brake rigging in the usual manner and is anchored to the brake drum as indicated in FIG. 3. Clutch device 72 is in clutching relation with the eccentric sleeve 54 under the biasing action of the spring 82, and is, of course, in splined relation with the nut 64. The normal tension in the brake rigging holds the brake drum protubrance of projection 106 against the stop lug 104.

The brake chain 28 is wound on the brake drum 26 to set the car brakes by the operator grasping the hand wheel 24 and rotating it clockwise of FIGS. 1, 3 and 5. The tension in the brake chain 28 acting through the brake drum 26, gear mechanism 58, eccentric sleeve 54, and clutch device 72 on nut 64 is effective to rotate the nut 64 relative to the operating shaft 22 to seat the nut, and specifically its clutching portion 68, against the clutching portion 70 of the ratchet device 60, whereby, as the shaft 22 is rotated to accomodate rotational movement relative to the back bearing plate annular flange 44, and thus with respect to the housing 11. The ratchet device 60 precludes a significant amount of rotation of the operating shaft 22 in a counterclockwise direction as long as the nut 64 remains flush to the ratchet device 60.

Rotational movement of the shaft 22 in a clockwise direction also effects rotation of the eccentric sleeve 54 through clutch device 72, which cams the pinion 52 to gyrate (as distinguished from rotate) relative to the shaft 22 in such a manner that the portion of the pinion gearing which meshes with gearing of the ring gear portion 50 revolves about the shaft 22 to effect the chain winding movement of the drum 26.

In one specific form of the invention illustrated in FIGS. 1–9, the pinion 52 is provided with 38 teeth and the drum ring gear portion 50 is provided with 39 teeth, which provides a full power brake mechanism that winds the brake chain from the left to the right of FIGS. 1, 3 and 5 in applying the brakes.

The brake chain wind up continues until the brakes are fully applied, with the ratchet mechanism then automatically operating to preclude release of the hand brake after brake setting has been completed.

During the brake setting operation, the pinion pins 53 (being seated within the respective fixed front and rear bearing plates 40 and 42) serve as a purchase against which the pinion 52 operates as is necessary for torque application to the winding drum. In operation, the pinion 52 is in engagement with at least one of the pins 53 at all times, the pins 53 following circular paths within their respective bearing plate mounting openings 55 and 57.

When controlled release of the brake is desired, the operator moves the hand wheel 24 counterclockwise of FIGS. 1, 3 and 5, which has the effect of turning the operating shaft 22 relative to the nut 64 at threading 66 so as to sufficiently loosen the clutch device 62, by feeding the nut 64 a limited amount to the right of FIG. 2, that some pay out of the brake chain 28 is permitted under the tension acting on same, which action rotates the brake drum 26, the eccentric sleeve 54, the clutch device 72, and the nut 64 as a unit, relative to the shaft 22, so as to return the nut 64 into clutching relation with the ratchet device 60, whereby the clutch device 62 is automatically operated to set the brake against further release of the brake chain. The operator can thus effect gradual release by continuing counterclockwise movement of the hand brake at the speed at which he wishes to effect the gradual brake release.

When it is desired to provide a free or full release to the brakes, the release handle 84 is grasped and moved upwardly of FIG. 1 to rotate the release shaft 86 in the direction that will cause the cam ring 88 to cooperate with the cam portion 90 of the bearing plate 40 so as to shift the cam ring 88 axially of the operating shaft to the right of FIG. 2, against the biasing action of spring 82, to effect removal of the lugs 76 of jaw clutch member 74 of the pockets 80 of eccentric sleeve 54. As the tension on the brake chain 28 is resisted through the brake drum 26 and its ring gear portion 50, pinion 52, and eccentric sleeve 54, the drum 26 then will freely turn as the brake chain 28 pays out from the hand brake under the tension acting on same, wth the pinion 52 freely gyrating and the eccentric sleeve 54 rotating in accordance with the gyrations of the pinion 52. The nut 64 and clutch device 62 remain uneffected by the full brake release involved except, of course, the operating shaft 22 is free of torque applied to same as the result of tension acting on the brake chain since the operating shaft is now uncoupled from the brake drum.

When the projecting portion 106 of the brake drum engages stop lug surface 108, the release handle 84 is released by the operator and returns by gravity to the position of FIG. 1.

Figure 10:
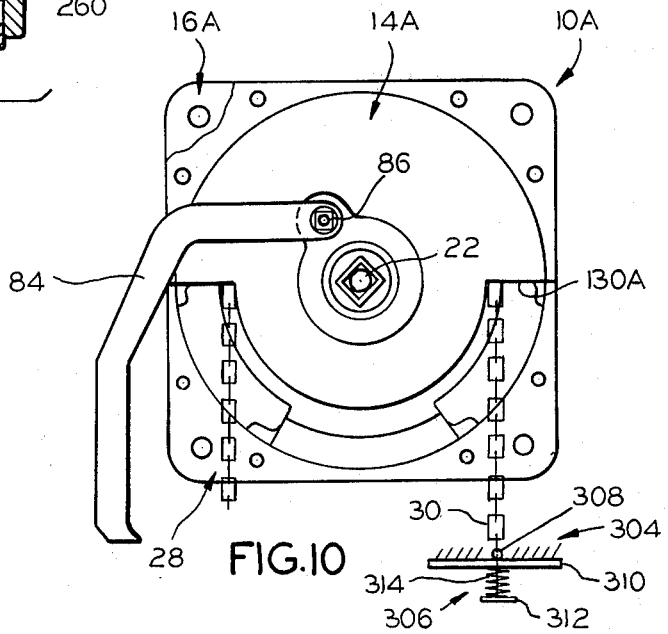
FIG. 10 is a view similar to that of FIG. 1 but on a reduced scale, illustrating the device arranged for continuous wind.

In the embodiment of FIG. 10, the hand brake 10A is essentially the same as the hand brake 10 except that the hand brake 10A is arranged for continuous wind wherein the brake chain end 30 extends through the hand brake for anchoring to some part of the car exterior of the hand brake, to provide the desired stoppage of brake release movement. In this embodiment, the brake drum 26 may be revolved in excess of 360° as may be necessary or desirable, and for this purpose the stop lug 104 is omitted, and a drum comparable to drum 26 but without projection 106 should be employed.

SPECIFIC DESCRIPTION

The front casing 14 is of dished configuration defining a forward wall 120 that is generally planar in configuration about a central outward indentation at 122 in which the operating and release shafts are journaled. The forward wall 120 is integral with the rounded side wall 124 that is flared outwardly as at 126 and merges into integral planar side flange 128 that is of the same general quadrilateral configuration as the rear plate 16, and defines the bolt openings 18 at its corners 20 that are aligned with the corresponding openings and corners 19 and 21 of the back plate 16 for securement of these components together and to the base plate 23, as by employing suitable bolts (not shown). These components may also be riveted together as at 129.

The front casing is formed on one side of same, in the limited wind form of the device, with chain accommodating opening 130. In the embodiments illustrated the corners of the front casing 14 and back plate 16 at the opening 130 are omitted, the bolt securement of these two plates at the other three corners of the housing being adequate.

The front casing wall 120 in its inward indentation 122 is formed with central opening 136 (see FIG. 2) in which is suitably mounted bearing 138 in which the operating shaft 22 is journaled insofar as the front casing 14 is concerned. Bearing 138 is fixed to the front casing 16 as by being welded at 139.

The front casing outward indentation is also formed with opening 140 (see FIG. 2) in which is suitably mounted the bearing 142 in which release shaft 86 is journaled. The release shaft includes a portion 144 of polygonal configuration to which the release handle 84 is keyed, with the handle being secured in place by employing a suitable lock nut 145 to the threaded stud end 148 of the release shaft. Bearing 142 is grooved at 141 to receive seal 143 in sealing relation with shaft 86.

The front and rear bearing plates 40 and 42 are suitably affixed to the front casing and back plate as shown at 149 for the front bearing plate respectively, as by riveting. In the form illustrated, the front bearing 40 is shown in FIG. 8 to be formed with rivet receiving recess 131 for this purpose and the back bearing plated is formed with similar recesses (not shown). As indicated, the annular flange 44 is integral with the back bearing plate 42 and defines a bore 135 in which the inner end 46 of the operating shaft 22 is journaled. For this purpose, the shaft 22 is formed with a reduced end portion 137 on which is threaded a suitable bearing ring 137A (see FIG. 2) fixed in mounted position as by welding at 147.

The operating shaft 22 at its outer end 151 is threaded as at 153 for application thereto of securing nut 155 that bears against lock washer 150 and the hub 152 of the hand wheel for the purpose of mounting the hand wheel 24 in operating position. Operating shaft 22 is formed with polygonal portion 154 with which the bore 156 of the hand wheel hub 152 makes a complementary fit, as is conventional with devices of this type.

The operating shaft 22 further includes an enlarged cylindrical portion 158 which is journaled in the bearing 138, the latter being provided with groove 160 (see FIG. 2) that receives suitable seal 162 applied against bearing 138 for sealing purposes. The shaft portion 158 is flanged as at 164 to define a rounded mounting surface 166 on which the spring 82 is seated. The spring 82 is a suitable type of conventional wave spring.

The brake drum 26 in the form illustrated is of one piece integral construction formed from a suitable casting operating or the like and formed at its protuberance or projecting portion 106 with a pair of aligned openings 170 that receive the pin 172 which anchors the chain end 30 to the brake drum. As indicated in FIG. 2, the brake drum is formed to define a central portion 174 which, on its inwardly facing side, is internally toothed as at 176 to define teeth 178 of ring gear portion 50 which are in meshing relation with the corresponding teeth 180 of the pinion 52. The central portion 174 of the drum 26 about its outwardly facing side is formed to define the drum chain winding surfacing or drum portion about the drum periphery 182 that is shown in the drawings. Thus, the drum central portion 174 is recessed as at 181 about its periphery 182 to receive alternate links of the chain, with the drum being flanged as at 184 to receive the front and rear bearing plates 40 and 42, respectively for brake drum journaling purposes.

The front bearing plate is recessed at 185 to receive seal 186 while the back bearing plate is recessed at 187 to receive seal 188. Seals 186 and 188 are in sealing relation with drum 26.

The pinion 52 is annular in configuration and defines a concentric bore 190 that is concentric with respect to the pitch diameter of the pinion teeth 180. In practice the pinion 52 is in the form of a disc 192 suitably shaped to give the configuration indicated, including the openings 51 for pins 53, and the teeth 180.

The eccentric sleeve 54 is generally annular in configuration and defines a rim portion 194 in which the seats 80 are formed, and an eccentric portion 196 (see FIG. 9) defining a cylindrical cam surface 198 that is struck about the eccentric axis 56. The sleeve 54 defines bore 200 that is to be concentric with the axis 25 of shaft 22. The sleeve 54 also is formed to define internal stop wall 202 to limit the movement of the sleeve 54 to the left of FIG. 2 relative to annular flange 44.

The needle bearings 98 and 100 are only diagrammatically illustrated and in practice may comprise roller bearing assemblies of any conventional type where this type of antifriction bearing is employed.

As indicated in FIG. 2, the operating shaft flange 164 and bearing ring 141 define an annular working space 210 about the shaft in which the ratchet assembly 60 and nut 64 are applied.

Figure 6:
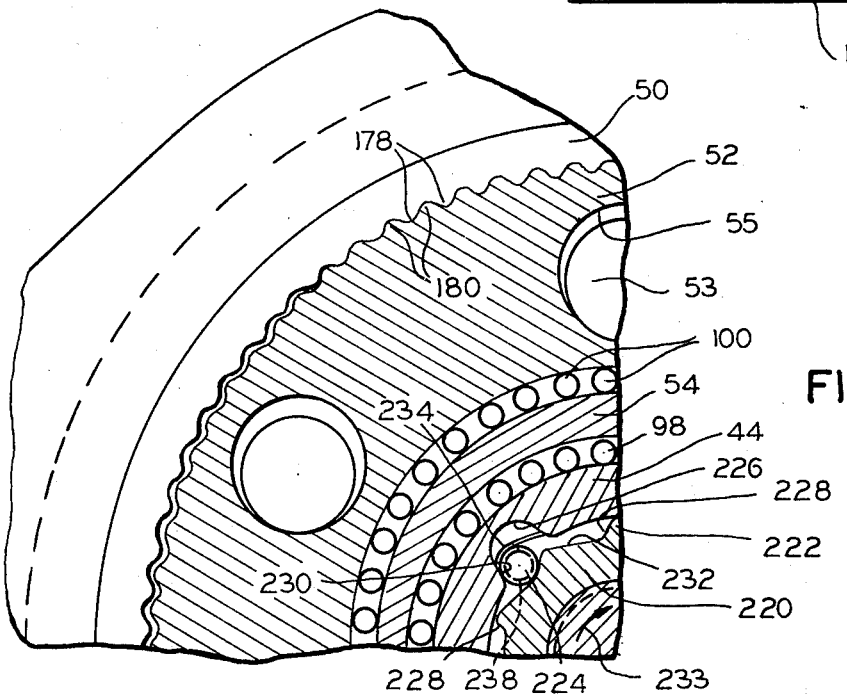
FIG. 6 is a view similar to that of FIG. 4 but illustrating on an enlarged scale a segment of the gearing and ratchet arrangements shown in FIG. 5.

The ratchet assembly 60 comprises an annular ratchet member 220 formed with spaced ratchet teeth 222 shaped to cooperated with the respective ratchet pins 224 that are respectively operably associated with elongate recesses or pocket 226 formed in the bore 136 of the annular flange 44 (see FIGS. 5 and 6). The teeth 222 are shaped to define an abrupt toothed surface 228 which is to engage the respective pins 224 and bias them against the end surface 230 of the respective recesses 226 to lock the ratchet against movement in one direction, with the teeth 222 also being formed with smoothly curved portion 232, that, when the ratchet 220 is turned in the direction of the arrow of 233 FIG. 6 relative to the annular flange 44, cams the respective pins 224 into the respective pockets or recesses 226 so that the pins will be bypassed by the respective ratchet teeth 222.

In the form shown, the pins 224 are biased against the ratchet member 220 by a garter spring 234 or the like, that biases pins 224 to the position of FIG. 6 relative to member 220, and holds these components together; the teeth 222 and pins 224 are suitably grooved as indicated at 236 and 238 respectively to accommodate the spring 234.

As already indicated the ratchet member 220 includes, at its end 239, clutch portion 70 which is formed internally to define friction clutch surface 240 with which the nut clutch portion 68 cooperates. Ratchet member 220 at its end 241 defines end surface 243 which bears against the operating shaft bearing ring 137A when clutch device 62 is operative. The ratchet member end surface 243 is planar and of substantially less area than the area of conically shaped clutch surface 240 to minimunize static friction engagement of member 220 with ring 137A to accommodate easy movement of the operating shaft, on actuation of same for controlled release, with respect to ratchet member 220.

The nut 64 is of annular configuration defining body 250 formed with internal threading 94 for threaded mounting on the shaft 22, and external friction clutch surface 252 along its clutch portion 68. The nut member 250 is flanged as at 254 in which the slots or grooves 78 are formed. The clutch surfaces 240 and 252 are of complemental configuration in the usual friction clutch surface engaging manner.

The jaw clutch member 74 is of annular configuration defining bore 260 for receiving the shaft 22. The member 74 also defines the integral lugs 76 which cooperate with the respective nut slots 78.

In this connection, the draft angle employed for the lugs 76, slots 78 of the nut member 250, and the seats 80 of the sleeve 54 preferably is less than what would achieve a balanced condition in terms of frictional forces acting on the relatively moving surfaces involved in operating the jaw clutch to open same and the reaction forces applied to the lugs 76 by the stresses acting on sleeve 54 and nut 64. By making the draft angles such that the tangent of the draft angle is equal to the coefficient of friction involved, a balanced condition is provided which for the present invention is not desirable as it is preferred to have sufficient friction drag to avoid accidental unclutching of the clutch device 72. As these components of the device will ordinarily be formed from steel, a draft angle of 11 or 12 degrees will provide the indicated balanced condition, and it is therefore preferred that the draft angle be in the range of 6° to 8°.

The cam ring 88 is annular in configuration and defines a bore 270 which receives the shaft 22, the nut 64, the jaw clutch prongs or lugs 76, and the thickened portion 194 of the eccentric sleeve 54 (see FIG. 2). The ring 88 defines a planar side 272 which abuts against the jaw clutch member 74, and a contoured side 274 which is shaped to define alternate high areas 276 and low areas 278 about the circumference of the ring 88 that are adapted to cooperate with corresponding high and low areas 280 and 282 defined by the cam portion 90 of the bearing plate 40.

The high and low surfaces of the cam ring 88 are ramped as at 284, while the high and low surfaces of the bearing plate 40 are ramped as at 286 whereby the camming action desired to achieve movement of the cam ring 88 longitudinally of the shaft 22, against the biasing action of spring 82, may be effect.

The bearing plate 40 and the cam ring 88 are oriented such that when the release handle 84 is in its position of FIG. 1, with the jaw clutch member 74 thus disposed in clutching engagement with the eccentric sleeve, under the action of biasing spring 82, the high surfaces 276 of the ring 88 will be in engagement with the low surfaces 282 of the bearing plate portion 90. The cam ring 88 is toothed as indicated at 290 for cooperation with the release shaft gearing indicated at 292 (see FIG. 7) whereby as the release handle 84 is lifted from the position of FIG. 1 in a clockwise direction, cam ring 88 is moved relative to bearing plate 40 to bring its ramping surfaces 284 against the ramping surfaces 286 of the plate 40 and cam the ring 88 over same so as to bring the ring surfaces 276 into engagement with the bearing plate surfaces 280, whereby the axial movement desired for the ring 88 is achieved. When the handle 84 is released, gravity acting on the handle 84 biases the release shaft 86 to reverse this operation, spring 82 acting to return ring 88 to its initial position with its high surfaces bearing against the low surfaces 282 of the bearing plate 40.

As indicated in FIG. 7, the release shaft is shouldered as at 294 and 296 for stopping engagement with the ring 88 to limit upward movement of handle 84 and also define its at rest position shown in FIG. 1.

For the diagrammatic showing of FIG. 7, the contoured side 274 of ring 88 faces to the rear of the figure, with the delinations of the ring high, low and ramping areas being indicated as shown for convenience of illustration.

As indicated in FIGS. 2 and 8, the bearing plate 40 is suitably apertured at 298 to accommodate the release shaft 86.

In the form shown in FIG. 10, the chain end 30 extends across the top of the winding drum 26 and out a second housing opening 130A for securement to the car where indicated at 304. This securement may include a suitable cushioning spring arrangement diagrammatically illustrated at 306. For this purpose the chain end 30 is shown secured to suitable I bolt 308 which passes through bracket plate 310 that is suitably fixed to the car (not shown). The bolt 308 carries spring seat 312 between which and the plate 310 is carried compression spring 314 to form the cushioning arrangement 306 that is diagrammatically illustrated for purposes of illustration. Front plate 14A and back plate 16A preferably have the marginal configurations shown in the corresponding figure of said application for securement together in the manner indicated in said application, for this embodiment of the present invention.

It will thus be seen that the invention provides a hand brake arrangement that is compact in assembly, effective in operation, and flexible as to application.

The general concentric arrangement of the winding drum and operating shaft provides a unit of compact size and arrangement.

The teeth arrangement of the brake drum 26 and pinion 52 may be varied to suit various purposes. For instance, the full power unit is provided with the pinion having thirty-eight teeth and the drum gear ring gear portion having thirty-nine teeth, while providing an embodiment where the pull on the chain is from the left hand side of the unit as viewed from the front side of same (see FIGS. 1, 3 and 5). By changing the number of teeth of the drum ring gear portion to forty, the device becomes a one-half power unit.

The designer has the alternative of making the teeth on the pinion greater in number than the teeth of the brake drum, which will result in the pull on the brake chain being from the right hand side of the unit as viewed from FIGS. 1, 3 and 5. thus, by providing the pinion 52 with 39 teeth and the drum gear with 38 teeth, the device is a high power unit with chain pull from the right side of same (viewed as indicated), in which case the chain end that is anchored to the car is at the left hand side of the form of FIG. 10. By providing the pinion with forty teeth meshing with thirty-eight teeth for the brake drum, a half power unit of the right hand chain pull type is provided.

The seals that are employed in connection with the release and operating shafts 22 and 86 as well as the brake drum 26 result in the gear device 58, the cam ring 88 and the cam portion 90 of bearing plate 40, the clutch devices 62 and 64, the annular flange 44, and the wave spring 82 being enclosed in a sealed spaced within the housing that may be suitably lubricated, as by being packed with a suitable grease.

The separating forces acting on the drum and the pinion as a result of tension in the brake chain are not applied to the operating shaft 22, but rather are transmitted through the needle bearings at annular flange 44 to the rear bearing plate 42, to the exclusion of the operating shaft.

As indicated, the device is readily adapted for either limited or continuous wind type application with the same basic parts provided for each, with the exception that for the continuous wind application the stop lug 104 and drum projection 106 are eliminated, and also, drum lugs of the type employed in application Ser. No. 521,339 be employed to keep the chain links in place. It will be apparent, of course, that the gearing arrangement of the pinion and ring gear portion of the brake drum may be made as desired to meet the needs of the particular application for which the device is to be applied. However, for railroad car use, the tooth arrangement that has been indicated is preferred.

The foregoing description and the drawings are given merely to explain and illustrate the invention and the invention is not be limited thereto, except insofar as the appended claims are so limited, since those skilled in the art who have the disclosure before them will be able to make modifications and variations therein without departing from the scope of the invention.

I claim:

1. A hand brake for railroad cars comprising:

a housing adapted to be mounted on a railroad car, an operating shaft journaled in said housing for rotation about an axis extending longitudinally of said shaft, a winding drum journaled in said housing for rotational movement about said axis and having a brake chain coupled thereto for being wound thereby, said winding drum including a ring gear portion, a sleeve journaled in said housing for rotational movement about said axis, said sleeve having a cam portion thereabout that is in eccentric relation to said axis, a pinion journaled on said sleeve cam portion and meshing with said drum ring gear portion in eccentric relation thereto for rotating said drum about said axis, ratchet means acting between said shaft and said housing for accommodating rotation of said shaft in one direction to wind said chain on said drum and opposing rotation of said shaft in the opposite direction, first clutch means for releasably clutching said shaft to said ratchet means on movement of said shaft in said one direction and for declutching said shaft from said ratchet means on movement of said shaft in the opposite direction, second clutch means for releasably clutching said shaft to said sleeve for rotating said sleeve on rotation of said shaft in said one direction to actuate said pinion to rotate said drum in its chain wind up direction and for declutching said shaft from said sleeve to effect quick release of the brake under the tension in said chain, and means for actuating said first clutch means for releasably clutching said shaft to said ratchet means, when said second clutch means is in clutching relation with said sleeve, under the tension in said chain, to maintain said shaft against rotational movement in said opposite direction thereof.

2. The hand brake set forth in claim 1 wherein:

said housing includes a pair of spaced apart bearings mounted therein each defining a bearing surface concentric about said axis and said shaft, said drum being journaled on and between said bearings, said housing having fixed to same an annular flange concentric with and about said shaft on which said sleeve is journaled, whereby tension in the brake chain acting on the drum stresses said bearings and said annular flange to the exclusion of said shaft.

3. The hand brake set forth in claim 2 wherein:

said ratchet means comprises:

an annular ratchet member received about said shaft and within said flange, said flange being formed with internal circumferentially spaced pockets thereabout, and rolling bearing means cooperating between said ratchet member and said flange pockets for accommodating said rotation of said shaft in said one direction and opposing said rotation of said shaft in said opposite direction.

4. The hand brake set forth in claim 3 wherein:

said first clutch means comprises:

a nut threaded on said shaft, said nut and said ratchet member being formed with cooperating friction clutch surfaces, with said nut being threaded on said shaft to be brought into clutching relation with said ratchet member when said shaft is rotated in said one direction relative to said nut.

5. The hand brake set forth in claim 4 wherein:

said second clutch means comprises:

an annular jaw clutch member received about said shaft in substantial concentric relation thereto and defining clutching teeth circumferentially spaced thereabout, said sleeve being formed to define sockets circumferentially spaced thereabout adapted to receive said jaw clutch member teeth in clutching relation to said sleeve, said jaw clutch member being mounted for movement axially of said shaft into and out of clutching relation to said sleeve sockets, means for biasing said jaw clutch member to said clutching relation, and means for moving said clutch member in opposition to said biasing means into out of clutching relation.

6. The hand brake set forth in claim 5 wherein:

said actuating means comprises:

said nut being splined to said jaw clutching teeth, whereby when said jaw clutch member is in its said clutching relation with said sleeve the tension in said chain acts on said nut through said second clutch means.

7. The hand brake set forth in claim 2 wherein:

said shaft has one end of same journaled within said annular flange.

with the other end of said shaft being external of said housing and including leverage applying means for rotating same.

8. The hand brake set forth in claim 5 wherein:

said means for moving said jaw clutch member in opposition to said biasing means comprises:

a release shaft journaled in said housing, and cam means actuated by said release shaft and engaging said jaw clutch.

9. The hand brake set forth in claim 6 wherein:

said housing comprises a front casing and a back plate operatively secured together, one of said bearings being fixed to said back plate and the other of said bearings being fixed to said front casing, said annular flange being integral with said one bearing.

10. The hand brake set forth in claim 9 wherein:

said means for moving said jaw clutch member in opposition to said biasing means comprises:

a release shaft journaled in said housing, an annular cam follower engaging said jaw clutch member and mounted for pivotal movement about said axis, said jaw clutch biasing means biasing said cam follower through said jaw clutch member against cam surfacing shaped to shift said cam follower axially of said shaft against said jaw clutch on rotation of said cam follower about said axis, and means for coupling said release shaft to said cam follower for pivoting same on pivotal movement of said release shaft.

11. The improvement set forth in claim 4 wherein:

said ratchet member has an end portion bearig against said shaft when said first clutch means is operative, said ratchet member end portion defining a friction surface of less area than said ratchet member clutch surface.

12. The improvement set forth in claim 11 wherein:

said first clutch means clutch surfaces are frustoconical in configuration, and said ratchet member end portion friction surface is planar in configuration.

13. A hand brake for railroad cars comprising:

a housing adapted to be mounted on a railroad car, an operating shaft journaled in said housing for rotation about an axis extending longitudinally of said shaft, a winding drum journaled in said housing for rotational movement about said axis and having a brake chain coupled thereto for being wound thereby, said winding drum including a ring gear portion, a sleeve journaled in said housing for rotational movement about said axis, said sleeve having a cam portion thereabout that is in eccentric relation to said axis, a pinion journaled on said sleeve cam portion and meshing with said drum ring gear portion for rotating said drum about said axis, ratchet means for accommodating rotation of said shaft in one direction to wind said chain on said drum and opposing rotation of said shaft in the opposite direction, first clutch means for releasably clutching said shaft to said ratchet means on movement of said shaft in said one direction and for declutching said shaft from said ratchet means on movement of said shaft in the opposite direction, second clutch means for releasably clutching said shaft to said sleeve for rotating said sleeve on rotation of said shaft in said one direction to actuate said pinion to rotate said drum in its chain wind up direction and for declutching said shaft from said sleeve to effect quick release of the brake under the tension in said chain, and means for actuating said first clutch means for releasably clutching said shaft to said ratchet means, when said second clutch means is in clutching relation with said sleeve, under the tension in said chain to maintain said shaft against rotational movement in said opposite direction thereof, said housing including a pair of spaced apart bearings mounted therein each defining a bearing surface concentric about said axis and said shaft, said drum being journaled on and between said bearings, said housing having fixed to same an annular flange concentric with and about said shaft on which said sleeve is journaled, whereby tension in the brake chain acting on the drum stresses said bearings and said annular flange to the exclusion of said shaft.

14. A hand brake for railroad cars comprising:

a housing adapted to be mounted on a railroad car, an operating shaft journaled in said housing for rotation about an axis extending longitudinally of said shaft, a winding drum journaled in said housing for rotational movement about said axis and having a brake chain coupled thereto for being wound thereby, said winding drum including a winding periphery on which said brake chain may be wound and a ring gear portion encompassed by said drum periphery, said housing including a pair of spaced apart bearings mounted therein concentric about said axis and said shaft, said drum adjacent its said periphery being journaled on and between said bearings, a sleeve journaled in said housing for rotational movement about said axis, said sleeve having a cam portion thereabout that is in eccentric relation to said axis, a pinion journaled on said sleeve cam portion and meshing with said drum ring gear portion in eccentric relation thereto for rotating said drum about said axis, ratchet means acting between said shaft and said housing for accommodating rotation of said shaft in one direction to wind said chain on said drum periphery and opposing rotation of said shaft in the opposite direction, first clutch means for releasably clutching said shaft to said ratchet means on movement of said shaft in said one direction and for declutching said shaft from said ratchet means on movement of said shaft in the opposite direction, second clutch means for releasably clutching said shaft to said sleeve for rotating said sleeve on rotation of said shaft in said one direction to actuate said pinion to rotate said drum in its chain wind up direction and for declutching said shaft from said sleeve to effect quick release of the brake under the tension in said chain, and means for actuating said first clutch means for releasably clutching said shaft to said ratchet means, when said second clutch means is in clutching relation with the sleeve, under the tension in said chain, to maintain said shaft against rotational movement in said opposite direction thereof.

15. The hand brake set forth in claim 14 wherein:

said housing has fixed to same an annular flange concentric with and about said shaft on which said sleeve is journaled, whereby tension in the brake chain acting on the drum stresses said bearings and said annular flange to the exclusion of said shaft.

* * * * *